United States Patent [19]

Barber, Jr.

[11] 4,030,253

[45] June 21, 1977

[54] METHOD OF CASTING BENEFICIATION

[75] Inventor: William R. Barber, Jr., Portland, Oreg.

[73] Assignee: Esco Corporation, Portland, Oreg.

[22] Filed: Apr. 14, 1976

[21] Appl. No.: 676,677

[52] U.S. Cl. ..... 51/321
[51] Int. Cl.[2] ..... B24C 1/00
[58] Field of Search ..... 51/8 R, 11, 14, 319–321

[56] References Cited

UNITED STATES PATENTS

| | | | |
|---|---|---|---|
| 2,632,980 | 3/1953 | Ransohoff | 51/320 X |
| 2,763,964 | 9/1956 | Luce | 51/11 X |
| 3,069,810 | 12/1962 | Blackman | 51/320 X |
| 3,427,763 | 2/1969 | Maasberg | 51/321 |

*Primary Examiner*—Gary L. Smith
*Attorney, Agent, or Firm*—Tilton, Fallon, Lungmus, Chestnut & Hill

[57] ABSTRACT

A method for removal of undesirable surface material from a casting employing a water abrasive jet operating at low pressure, i.e., 8,000 psi (55°kg/cm²) — 12,000 psi (850kg/cm²).

7 Claims, 4 Drawing Figures

METHOD OF CASTING BENEFICIATION

BACKGROUND AND SUMMARY OF INVENTION

This invention relates to a method of casting beneficiation, i.e., removing undesirable surface material from castings, and more particularly to the removal of such material through impingement on the casting surface of an abrasive-containing water jet.

In steel foundry practice, even under the best controlled conditions, surface defects occur. Where the surface has to meet certain tolerances — as for providing a bearing surface, or has to evidence a sheen — as in the case of stainless steel castings, it has required arduous grinding to remove the defective surface material. Three general types of defects are prevalent: sand burn-in resulting from the surface metal taking up minute particles of the molding sand, scale resulting from surface oxidation incident to heat treating, and adherence of crushed core and molding sand in highly inaccessible places — such as for locking pins and the like.

In the past it has been necessary to equip a steel foundry artisan with a grinder to work on occasions for hours to remove the defective material from the casting — and even then the removal might not be complete. For these jobs the usual expedients of shot impingement "wheelabrating" or sand blasting were inadequate.

It was well known that metal such as steel could be cut through the use of abrasive-containing high pressure jets, i.e, operating at pressures above 30,000 psi (2000kg/cm²). However, such jets have not proved attractive to foundry art workers because of their high cost — particularly the cost of the intensifiers needed for developing the high pressure. It was also known that metal could not be economically cut with the commonly employed low pressure jets, i.e., those operating in the range of 8,000 psi (550kg/cm²) to 12,000 psi (850kg/cm²) — and this was irrespective of whether abrasive was employed or not. Therefore, it was most surprising to discover that a low pressure abrasive-augmented water jet operating under certain conditions possessed the selective capability of removing integral, deteriorated metal from a casting and in times which were a minor fraction of the previously known grinding times. The important operating conditions include sizing the jet-providing nozzle to deliver from about 10 gallons per minute (38 liters/min) to about 12 gallons per minute (45 liters/min) of water containing from about 5 lbs/min (2.2 kg/min) to about 7 lbs/min (3.2kg/min) of a specific abrasive — the most useful economically being garnet sand passing an SAE size 14 screen.

DETAILED DESCRIPTION

The invention is described in conjunction with an illustrative embodiment in the accompanying drawing, in which FIG. 1 is a front elevational view partially in section of apparatus employing the invention;

Figure 1:
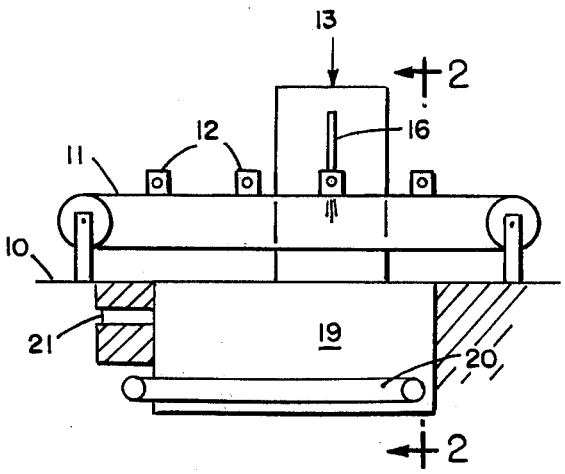
Figure 2:
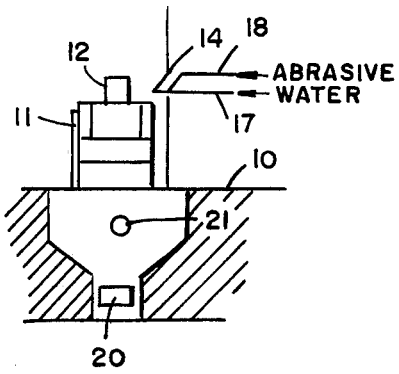
FIG. 2 is a sectional view taken along the line 2—2 of FIG. 1.

In the illustration given and with reference to FIGS. 1 and 2, the numeral 10 designates a floor or other support surface in a foundry. Mounted on the floor 10 is a conveyor 11 arranged to index castings 12 past a work station generally designated 13.

Figure 4:
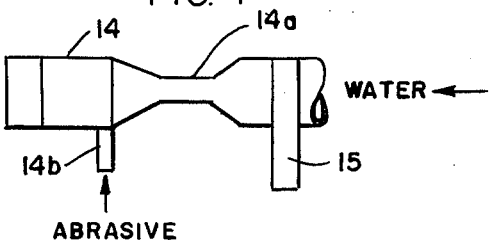
FIG. 4 is an enlarged fragmentary elevational view of the nozzle portion of the apparatus of the preceding views.

The key feature of the work station 13 is a nozzle 14 (see FIGS. 2 and 4) which is mounted in a fixture 15. The fixture 15 is advantageously mounted in the station 13 for vertical traverse — as indicated by the slot 16.

Coupled to the nozzle 14 is a hose or other conduit 17 conveying pressurized water from a pump (not shown). The nozzle 14 has a venturi section 14*a* and a lateral inlet 14*b* downstream therefrom for the purpose of deliverying abrasive to the system. Abrasive is conveyed from a source (not shown) via a hose or other conduit 18 to the inlet 14*b*.

Figure 3:
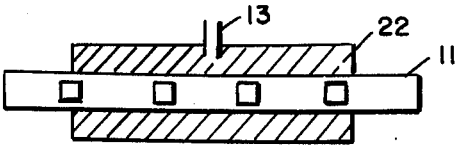
FIG. 3 is a top plan view of the apparatus of FIGS. 1 and 2.

The floor 10 is recessed to provide a pit 19 for collection of the water-abrasive mixture after the same has been jetted against the castings 12. The pit 19 is advantageously equipped with a sand removal conveyor 20 and a water overflow pipe outlet 21. Further the pit is covered by a metal grating 22 — see FIG. 3.

Because it is believed that the invention will be better understood from a consideration of specific examples, the following examples are set down:

EXAMPLE 1

For this example, the castings 12 were excavating tooth adapters of the type shown and described in co-owned U.S. Pat. No. 2,919,506. As such the adapters are equipped with a cast-in bore, the indise surface of which must be free of all scale to mate properly with a securing pin. To remove the scale by chipping, grinding, wheelabrating and sandblasting, it took an artisan an average of 60 minutes per casting whereas employing the inventive method resulted in the same scale removal in an average of 2.5 minutes.

The operating conditions included supplying 10 gpm (38 liters/min) of water at a distance of 5 inches and at a pressure of 9,500 psi (670kg/cm²) through a carbide sand nozzle having a rectangular aperture measuring 5/16 inches (7.9 mm) by 3/32 inches (2.4 mm) and adding thereto 5 lbs/min (2.2kg/min) of No. 14 (SAE screen size) Garnet sand.

EXAMPLE 2

The operating conditions of Example 1 were altered to supply 7 lbs/min (3.2kg/min) aluminum oxide having a No. 20 size (SAE screen size) to the water jet operating at 8,000 psi (550kg/cm²) with a flow rate of 12 gpm (45 liters/min) and using a nozzle having a circular bore of ⅛ inches (3.2 mm) and positioned 4 inches from the casting. The jet impinged on a large casting constructed of type 304 stainless steel in the form of a 50° elbow to be installed in a nuclear submarine. Prior to applying the inventive jet, approximately 30% of the surface was ground to remove burnt in sand. This required approximately 50 hours. A remaining 40% of the surface (of a fully equivalent character) had the objectionable metal removed in 6 hours through the use of the inventive method.

EXAMPLE 3

The operating conditions were varied further — ample power being available from a 120 HP engine — to deliver 11 gpm (42 liters/min) of water at 12,000 psi (850kg/cm²) through a nozzle equipped with a rectangular orifice measuring ⅛ inches (3.2 mm) by 1/32 inches (0.8 mm) and taking up 6 lbs/min (2.7kg/min) of coarse silica sand, of SAE No. 20 screen size. The jet was applied to the socket surfaces of excavating tooth points which required an average of 20 minutes per point to remove heat treat scale by grinding. Conventional methods such as sand blasting or blasting with steel shot were ineffective. However, with the inventive method removed, the scale on an average of 2 minutes per point.

From the foregoing it will be appreciated that substantial savings in manpower accrue from the practice of the invention. In general the material can be removed in about 10%-15% of the time required for grinding a similar casting. Even taking into account the cost of equipment and operation thereof, there still results substantial money savings and, in many cases, a superior job of material removal.

Although the mechanism by which the invention operates is imperfectly understood, it is believed that the advantageous results stem from a felicitous combination of operating conditions. The operating pressure is low, viz., in the range of 8,000 psi (550kg/cm$^2$) to 12,000 (psi (850kg/cm$^2$) to take advantage of the relatively inexpensive equipment capable of generating such pressures — displacement pumps versus the complex intensifiers required for higher hydraulic pressures. Such intensifiers are required for generating pressures generally above the 12,000 psi (850kg/cm$^2$) level. Pressures lower than 8,000 psi (550kg/cm$^2$) may be employed but only at the sacrifice of efficiency, i.e., longer times for less material removal.

The preferred range of water flow rates are functions of the power available and the nozzle size, once the pressure has been determined. Again, the flow rates of about 10–12 gpm (38–45 kg/min) correspond to the optimum — the same applying to the mass rates of flow of the abrasive at a pressure of about 10,000 psi (630 kg/cm$^2$).

The abrasive most advantageously used is Garnet sand having a particle size just passing a No. 14 SAE size screen. Some variation in type and size of abrasive is possible while still achieving the benefits of the invention. For example, abrasive particles having a crystal structure like that of Garnet sand, i.e., characterized by protruding "corners", are suitable. These include the above-mentioned aluminum oxide, silicon carbide and coarse silica sand. On the other hand, ordinary foundry sand (silicon dioxide) is less ineffective in removing material according to the invention than are other sands with particle sizes below SAE screen size 40. It may be possible to employ particle sizes greater than No. 14, viz., No. 12, but at the expense of efficiency inasmuch as these tend to fracture too easily.

A wide variety of casting shapes and material types can have the undesirable surface material removed therefrom. Burnt in sand can be removed from such disparate castings as dragline buckets, shovel dippers and crusher jaws.

I CLAIM:

1. A method of removing adherent deteriorated surface material from metal castings comprising positioning said surface at a distance of from about 4 inches (10 cm.) to about 6 inches (15 cm.) from a jet nozzle, flowing a water-abrasive mixture through said nozzle into impinging relation with said surface at a pressure of from about 8,000 psi (550kg/cm$^2$) to about 12,000 psi (850kg/cm$^2$) at a flow rate of from about 10 gpm (38 liters/min.) to about 12 gpm (45 liters/min.) and including from about 5 lbs/min. (2.2kg/min) to about 7 lbs/min. (3.2kg/min) of an abrasive having a particle size in the range capable of passing an SAE size 14 screen but retainable on an SAE size 40 screen, said abrasive having a crystal structure characteristic of garnet sand.

2. The method of claim 1 in which said nozzle is vertically traversed over said surface.

3. The method of claim 1 in which said nozzle has a generally rectangular aperture.

4. The method of claim 1 in which said casting is indexed horizontally past said nozzle.

5. A method of removing adherent deteriorated surface material consisting of sand burned in from metal castings comprising positioning said surface at a distance of from about 4 inches (10 cm.) to about 6 inches (15 cm.) from a jet nozzle, flowing a water-abrasive mixture through said nozzle into impinging relation with said surface at a pressure of from about 8,000 psi (550kg/cm$^2$) to about 12,000 psi (850kg/cm$^2$) at a flow rate of from about 10 gpm (38 liters/min.) to about 12 gpm (45 liters/min.) and including from about 5 lbs/min. (2.2kg/min.) to about 7 lbs/min. (3.2kg/min.) of an abrasive having a particle size in the range capable of passing an SAE size 14 screen but retainable on an SAE size 40 screen, said abrasive having a crystal structure characteristic of garnet sand.

6. A method of removing adherent deteriorated surface material consisting of oxidation from heat treating from metal castings comprising positioning said surface at a distance of from about 4 inches (10 cm.) to about 6 inches through said nozzle into impinging relation with said surface at a pressure of from about 8,000 psi (550kg/cm$^2$) to about 12,000 psi (850kg/cm$^2$) at a flow rate of from about 10 gpm (38 liters/min.) to about 12 gpm (45 liters/min.) and including from about 5 lbs/min. (2.2kg/min) to about 7 lbs/min. (3.2kg/min) of an abrasive having a particle size in the range capable of passing an SAE size 14 screen but retainable on an SAE size 40 screen, said abrasive having a crystal structure characteristic of garnet sand.

7. A method of removing adherent deteriorated surface material consisting of crushed core and molding sand from metal castings comprising positioning said surface at a distance of from about 4 inches (10 cm.) to about 6 inches (15 cm.) from a jet nozzle, flowing a water-abrasive mixture through said nozzle into impinging relation with said surface at a pressure of from about 8,000 psi (550kg/cm$^2$) to about 12,000 psi (850kg/cm$^2$) at a flow rate of from about 10 gpm (38 liters/min.) to about 12 gpm (45 liters/min.) and including for about 5 lbs/min. (2.2kg/min) to about 7 lbs/min. (3.2kg/min) of an abrasive having a particle size in the range capable of passing an SAE size 14 screen but retainable on an SAE size 40 screen, said abrasive having a crystal structure characteristic of garnet sand.

* * * * *